US008651886B2

(12) United States Patent
Tai et al.

(10) Patent No.: US 8,651,886 B2
(45) Date of Patent: Feb. 18, 2014

(54) ELECTRICAL CONNECTOR ASSEMBLY WITH IMPROVED LOCKING STRUCTURES AND MATING DIRECTION

(75) Inventors: Hung-Chi Tai, Jhonghe (TW); Yung-Chih Hung, Jhonghe (TW)

(73) Assignee: Alltop Electronics (Suzhou) Co., Ltd, Taicang (CN)

( * ) Notice: Subject to any disclaimer, the term of this patent is extended or adjusted under 35 U.S.C. 154(b) by 0 days.

(21) Appl. No.: 13/598,799

(22) Filed: Aug. 30, 2012

(65) Prior Publication Data

US 2014/0011407 A1 Jan. 9, 2014

(30) Foreign Application Priority Data

Jul. 4, 2012 (CN) ..... 2012 1 0228917

(51) Int. Cl.
*H01R 13/62* (2006.01)

(52) U.S. Cl.
USPC ..... 439/345; 439/357; 439/607.04

(58) Field of Classification Search
USPC ..... 439/345, 350, 357, 607.04, 607.54
See application file for complete search history.

(56) References Cited

U.S. PATENT DOCUMENTS

| | | | | |
|---|---|---|---|---|
| 5,190,475 | A * | 3/1993 | Dickens | 439/588 |
| 5,730,613 | A * | 3/1998 | Yamada | 439/293 |
| 6,475,010 | B1 * | 11/2002 | Yu | 439/289 |
| 7,322,836 | B2 * | 1/2008 | Shun et al. | 439/135 |
| 7,458,847 | B1 * | 12/2008 | Hsu et al. | 439/568 |
| 8,147,254 | B2 * | 4/2012 | Shuey et al. | 439/74 |
| 8,277,241 | B2 * | 10/2012 | Horchler et al. | 439/295 |
| 2009/0203246 | A1 * | 8/2009 | Horchler et al. | 439/345 |
| 2011/0076871 | A1 * | 3/2011 | Yu et al. | 439/345 |
| 2012/0190217 | A1 * | 7/2012 | Tseng | 439/55 |
| 2013/0017704 | A1 * | 1/2013 | Kyle | 439/345 |

* cited by examiner

*Primary Examiner* — James Harvey
(74) *Attorney, Agent, or Firm* — Sughrue Mion, PLLC

(57) ABSTRACT

An electrical connector assembly includes mateable receptacle connector and plug connector. The receptacle connector includes a first insulative housing, a number of first contacts retained in the first insulative housing and a first metallic shell. The first metallic shell includes a pair of cantilevered claws extending downwardly from opposite sides thereof. When the plug connector is mated with the receptacle connector along a bottom-to-top direction, the pair of cantilevered claws are deformable so as to clamp the plug connector in position and prevent the plug connector from falling off from the receptacle connector along a top-to-bottom direction.

20 Claims, 14 Drawing Sheets

ELECTRICAL CONNECTOR ASSEMBLY WITH IMPROVED LOCKING STRUCTURES AND MATING DIRECTION

BACKGROUND OF THE INVENTION

1. Field of the Invention

The present invention relates to an electrical connector assembly, and more particularly, to an electrical connector assembly with a plug connector mateable with a receptacle connector along a bottom-to-top direction.

2. Description of Related Art

A conventional electrical connector assembly includes a receptacle connector and a plug connector. The receptacle connector usually includes a receptacle housing and a plurality of receptacle contacts retained in the receptacle housing. The plug connector usually includes a plug housing and a plurality of plug contacts retained in the plug housing. The receptacle housing and the plug housing usually include tongue portions, respectively, for mating with each other. However, conventional plug connector and receptacle connector are mated with each other along a contact-extending direction, which is restricted in use under special applications.

Hence, an improved electrical connector assembly with a plug connector vertically mating with a receptacle connector is desired.

BRIEF SUMMARY OF THE INVENTION

The present invention provides an electrical connector assembly including mateable receptacle connector and plug connector. The receptacle connector includes a first insulative housing, a plurality of first contacts retained in the first insulative housing and a first metallic shell fixed to the first insulative housing. The first insulative housing is provided with a first body and a first tongue extending horizontally from the first body. The first tongue defines a bottom mating surface. Each first contact includes a first/rigid contacting portion exposed on the bottom mating surface. The first metallic shell includes a pair of cantilevered claws extending downwardly from opposite sides thereof. The pair of cantilevered claws are positioned at lateral sides of the first tongue. The plug connector includes a second insulative housing and a plurality of second contacts retained in the second insulative housing. The second insulative housing includes a second body and a second tongue extending horizontally from the second body. The second tongue defines a top mating surface. Each second contact includes a second/elastic contacting portion extending upwardly beyond the top mating surface. The plug connector is mated with the receptacle connector along a bottom-to-top direction with the first/rigid contacting portions engaging with the second/elastic contacting portions. The pair of cantilevered claws are deformable so as to clamp the plug connector in position and prevent the plug connector from falling off from the receptacle connector along a top-to-bottom direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
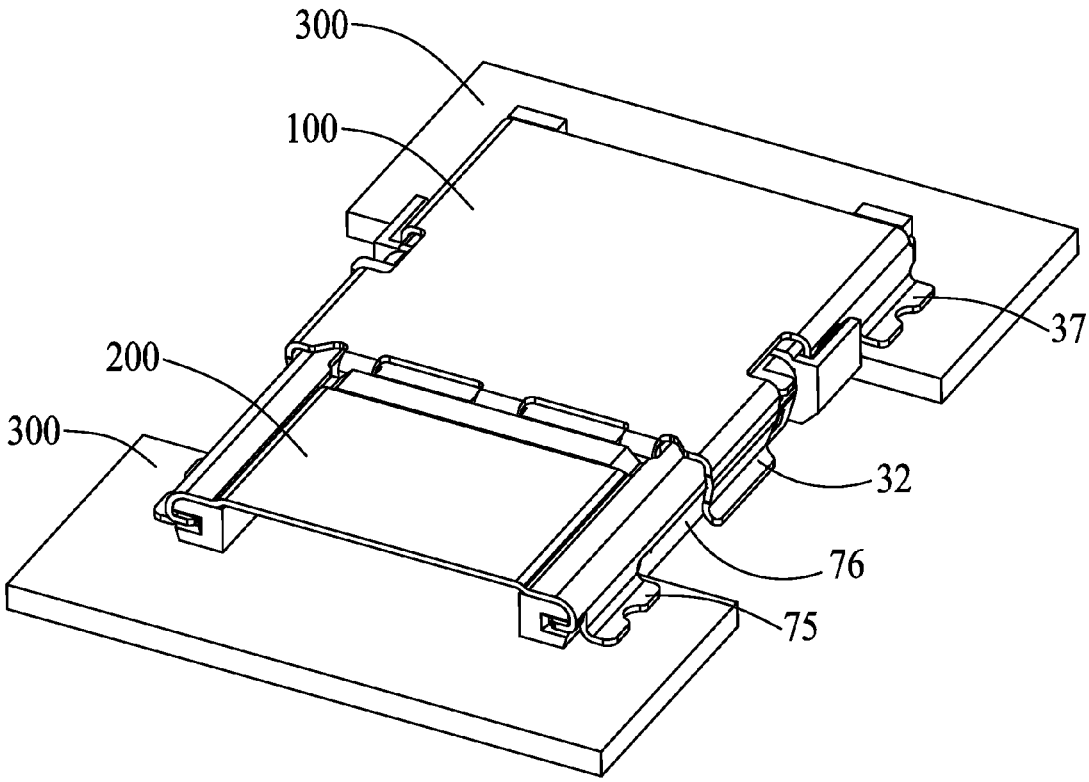
FIG. 1 is a perspective view of an electrical connector assembly for electrically connecting two circuit boards with a plug connector mateable with a receptacle connector in accordance with an illustrated embodiment of the present invention.

Reference will now be made to the drawing figures to describe the embodiments of the present invention in detail. In the following description, the same drawing reference numerals are used for the same elements in different drawings.

Figure 2:
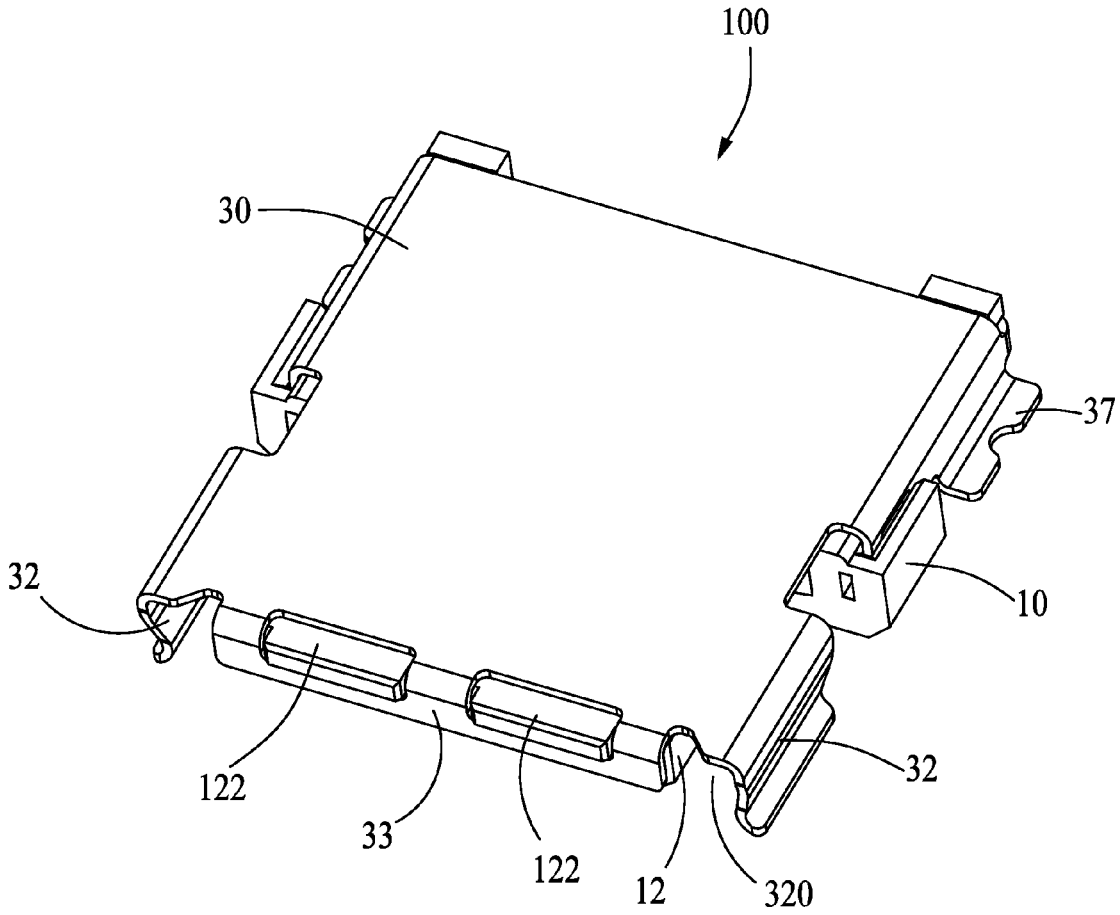
FIG. 2 is a perspective view of the receptacle connector as shown in FIG. 1.
Figure 9:
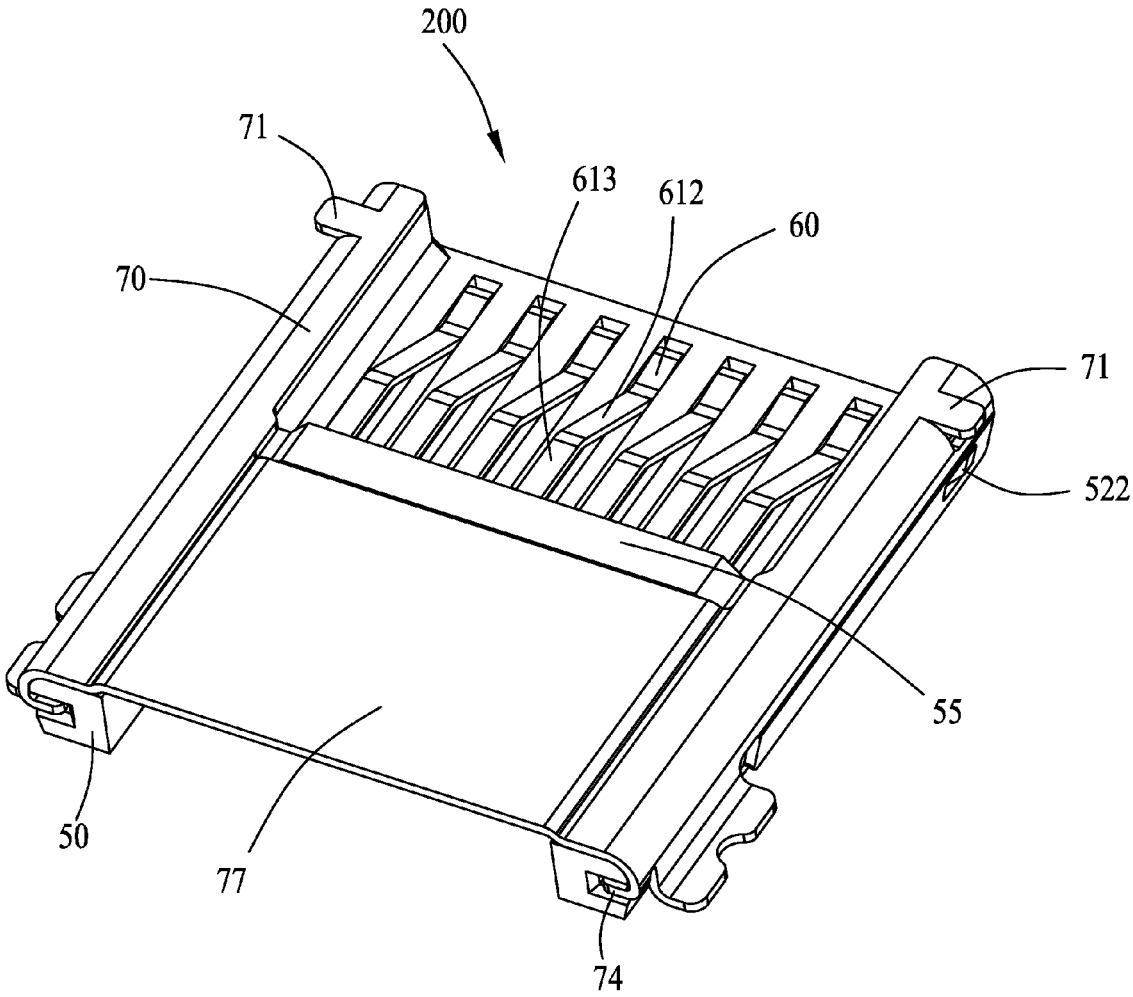
FIG. 9 is a perspective view of a plug connector as shown in FIG. 1.

Referring to FIGS. 1, 2 and 9, the present invention discloses an electrical connector assembly including a receptacle connector 100 and a plug connector 200 for mating with the receptacle connector 100 along a bottom-to-top direction. Both the receptacle connector 100 and the plug connector 200 are surface mounted on a circuit board 300. Further referring to FIGS. 2 and 3, the receptacle connector 100 includes a first insulative housing 10, a plurality of first contacts 20 retained in the first insulative housing 10 and a first metallic shell 30 fixed to the first insulative housing 10.

Figure 3:
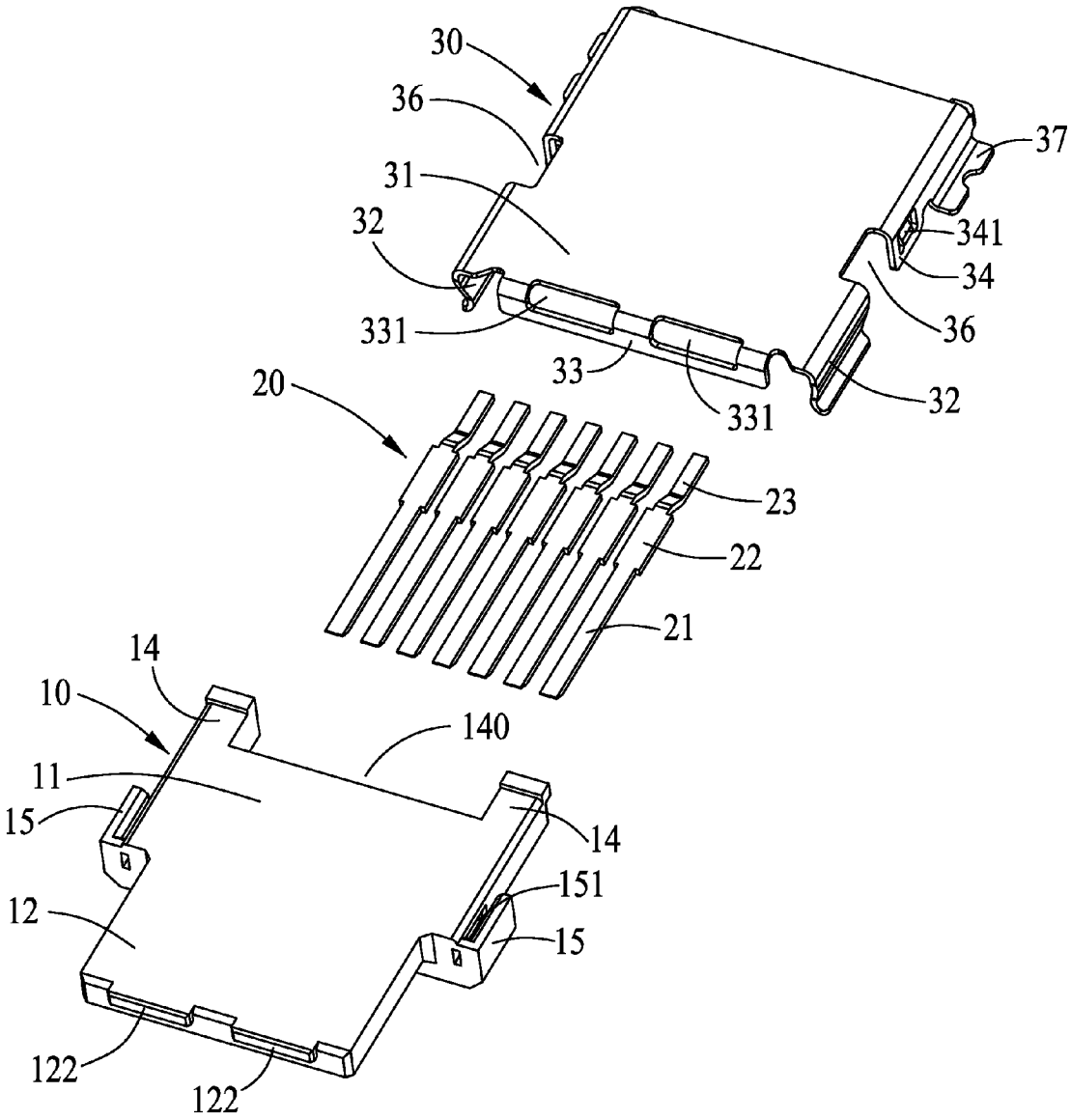
FIG. 3 is an exploded view of the receptacle connector as shown in FIG. 2.
Figure 4:
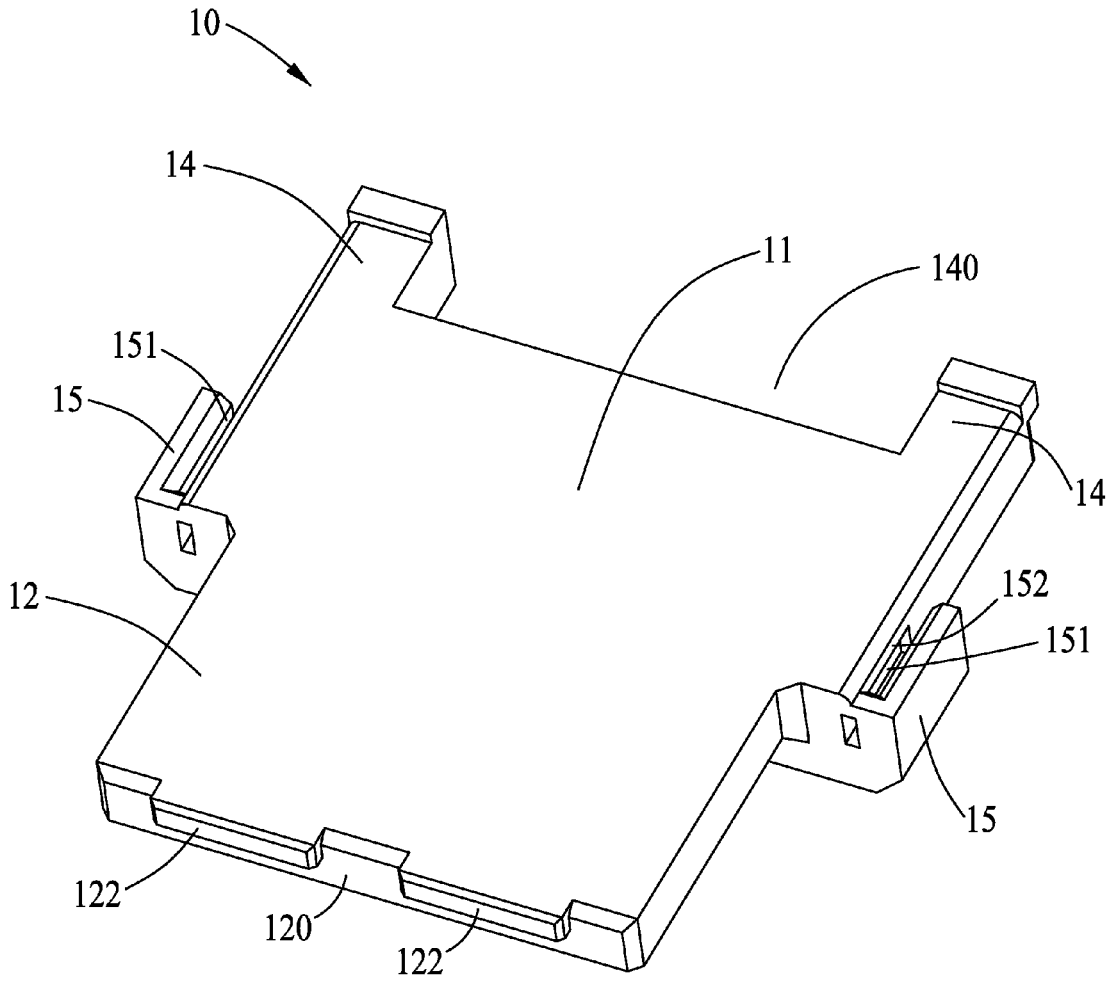
FIG. 4 is a perspective view of a first insulative housing of the receptacle connector as shown in FIG. 3.
Figure 5:
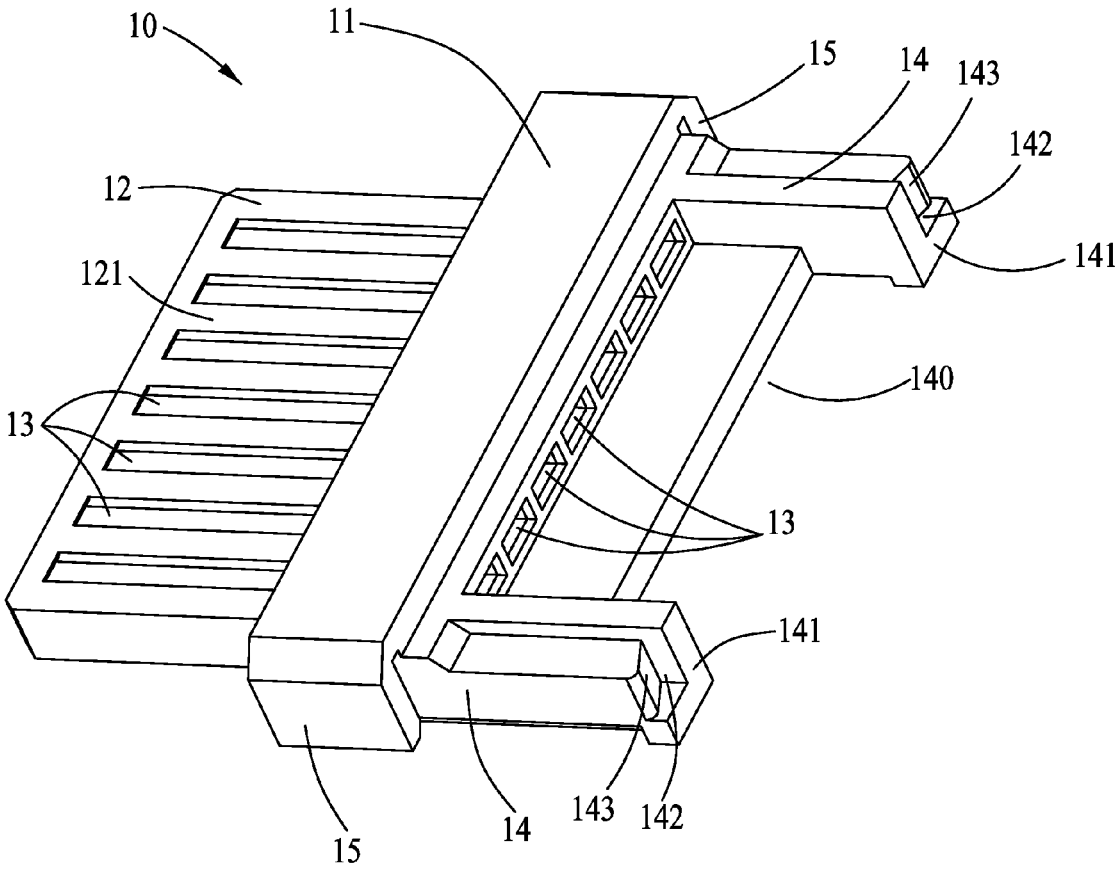
FIG. 5 is another perspective view of the first insulative housing while taken from a different aspect.

Referring to FIGS. 3 to 5, the first insulative housing 10 includes a first body 11, a first tongue 12 extending forwardly from the first body 11 and a pair of first rear portions 14 extending backwardly from opposite sides of the first body 11. The first body 11 and the pair of first rear portions 14 jointly form a U-shaped first mounting space 140. The first body 11 includes a pair of sideward protrusion blocks 15. Each protrusion block 15 defines a slit 151 and a top restricting wall 152 in communication with the slit 151. The first tongue 12 is rectangular shaped and includes a bottom mating surface 121. The first tongue 12 defines a plurality of first passageways 13 extending through the bottom mating surface 121. The first passageways 13 further extend backwardly through the first body 11 for mounting the first contacts 20. Besides, as shown in FIG. 4, the first tongue 12 includes a pair of protrusions 122 extending forwardly beyond a front surface 120 thereof for locking with the first metallic shell 30. As shown in FIG. 5, each first rear portion 14 defines a rear cutout 142 extending through a rear surface 141 thereof, and an inclined surface 143 exposed to the rear cutout 142.

Figure 6:
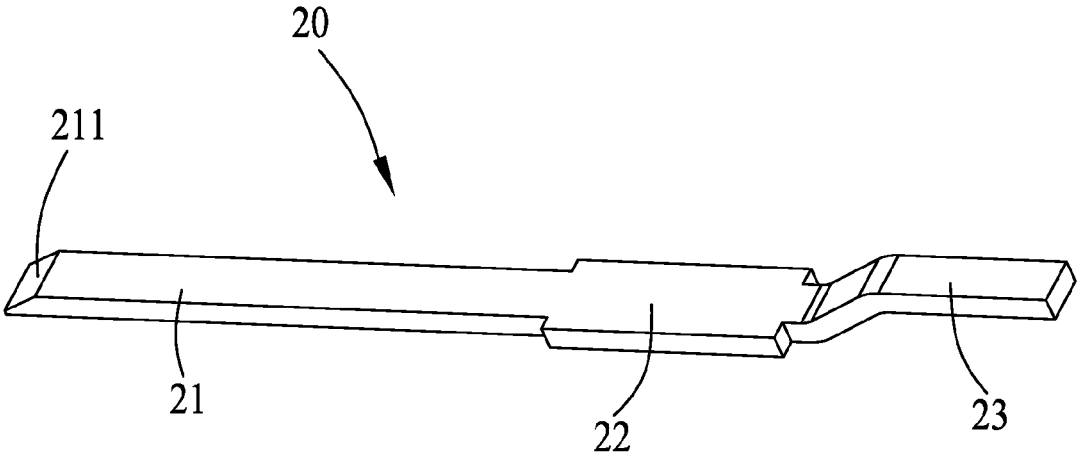
FIG. 6 is a perspective view of a first contact of the receptacle connector.

Referring to FIGS. 5 and 6, each first contact 20 includes a first retaining portion 22, a first contacting portion 21 extending forwardly from the first retaining portion 22 and a first soldering portion 23 extending backwardly from the first retaining portion 22. The first contacting portion 21 is flat and rigid. The first contacting portion 21 includes a front inclined guiding surface 121 for guiding insertion of the first contact 20 into corresponding first passageway 13. The first contacting portion 21 is exposed on the bottom mating surface 121 and also exposed in the air. The first retaining portion 22 is wider than either the first contacting portion 21 or the first soldering portion 23 so as to be stably fixed in the corresponding first passageway 13. The first soldering portion 23 extends beyond the first body 11 and into the first mounting space 140.

Referring to FIGS. 2, 3, 7 and 8, the first metallic shell 30 includes a flat top wall 31, a pair of cantilevered claws 32 extending downwardly from front opposite sides of the top wall 31, a pair of side portions 34 bent downwardly from rear opposite sides of the top wall 31, and a front portion 33 bent downwardly from a front edge of the top wall 31. The top wall 31 covers and engages with the first body 11 and the first tongue 12 of the first insulative housing 10. Furthermore, the first body 11 can be provided with a plurality of embossments or raised ribs (not shown) for engaging with the first insulative housing 10 so as to improve combination force therebetween. The front portion 33 shields the front surface 120 of the first tongue 12. A joint of the front portion 33 and the top wall 31 defines a pair of rectangular openings 331 to receive the pair of protrusions 122 for fixation.

Figure 8:
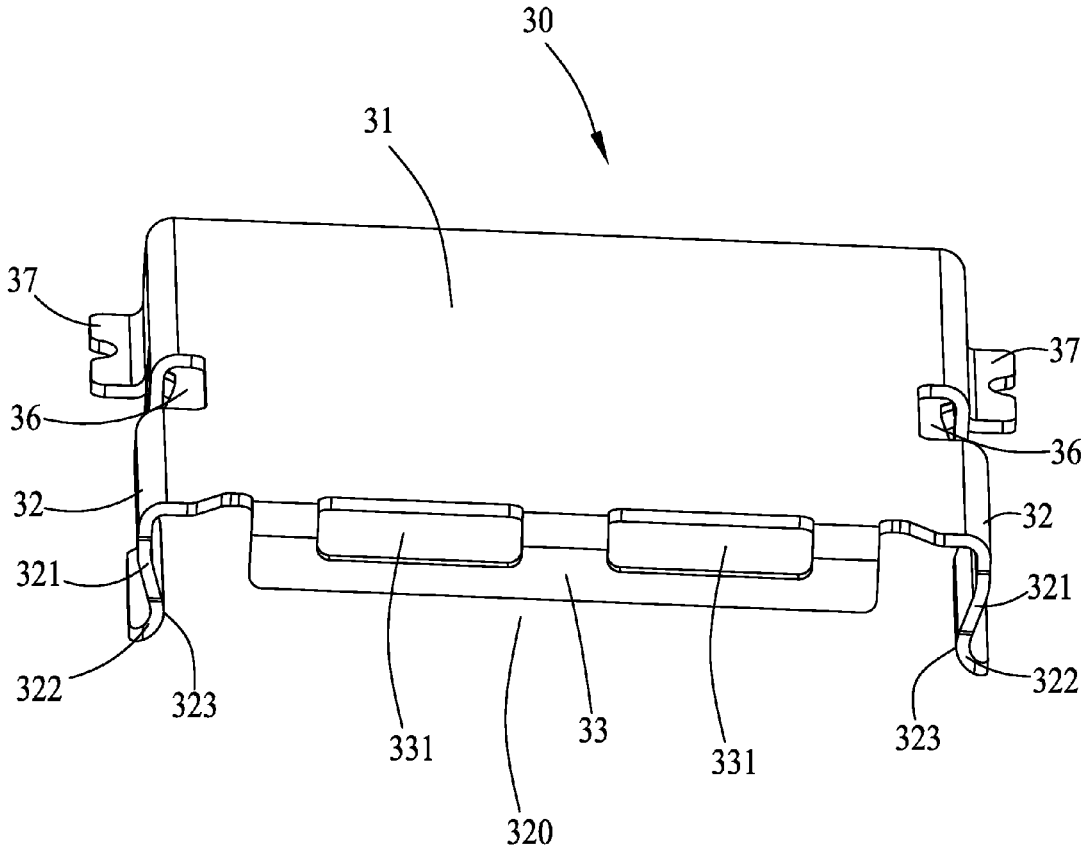
FIG. 8 is another perspective view of the first metallic shell of the receptacle connector while taken from a different aspect.

Referring to FIG. 8, the pair of cantilevered claws 32 are symmetrical with each other and form a space 320 therebetween. As shown in FIG. 2, the pair of cantilevered claws 32 are sidewardly separated from the first tongue 12 and are positioned at lateral sides of the first tongue 12. Each cantilevered claw 32 is substantially S-shaped and includes an upper arm 321 extending obliquely and inwardly into the space 320, a lower arm 322 extending outwardly with respect to the upper arm 321 and an inward locking protrusion 323 at a peak of the upper arm 321 and the lower arm 322. The lower arms 322 of the pair of cantilevered claws 32 are of an evase configuration for guiding insertion of the plug connector 200 into the space 320 along the bottom-to-top direction. From an integral viewpoint, a space (not labeled) formed between the upper arms 321 of the pair of cantilevered claws 32 is tapered from a top-to-bottom direction so that the space is much suitable for clamping the plug connector 200. According to the illustrated embodiment of the present invention, the pair of cantilevered claws 32 are integral with the first metallic shell 30. It is understandable that the pair of cantilevered claws 32 and the first metallic shell 30 can be separatedly made. Besides, in order to improve the clamping force between the plug connector 200 and the receptacle connector 100, each of the cantilevered claws 32 can be provided with embossments or raised ribs (not shown) for engaging with the plug connector 200.

Figure 7:
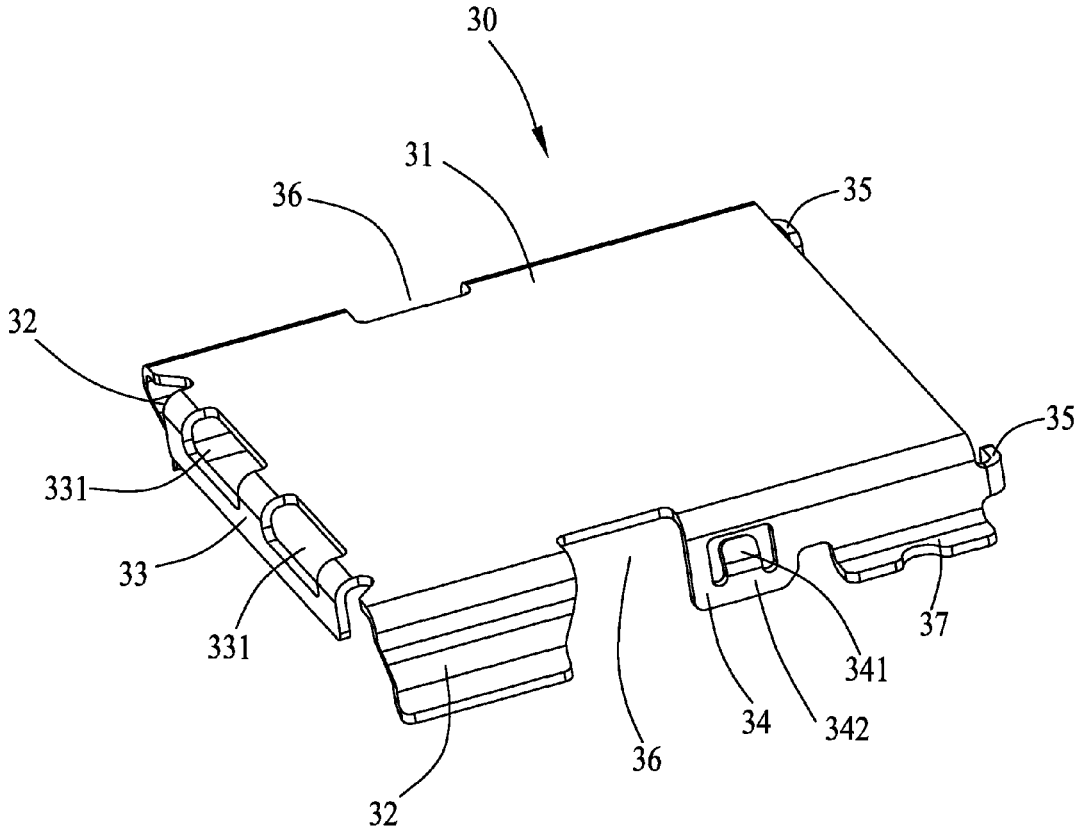
FIG. 7 is a perspective view of a first metallic shell of the receptacle connector as shown in FIG. 3.

Referring to FIG. 7, each side portion 34 includes a retaining portion 342 fixed in the slit 151 of the first body 11. The retaining portion 342 includes a slant tab 341 extending along the bottom-to-top direction. The slant tab 341 is stamped inwardly from the retaining portion 342. When the retaining portion 342 is wholly fixed in the slit 151 of the first body 11, the top restricting wall 152 presses against the slant tab 341 along the bottom-to-top direction so as to prevent the retaining portion 342 from escaping the slit 151. Besides, the first metallic shell 30 further includes a pair of soldering pads 37 extending horizontally and sidewardly beyond the side portions 34, respectively.

Besides, a pair of positioning slots 36 are formed between the cantilevered claws 32 and the retaining portions 342 along a front and back direction. The first metallic shell 30 further includes a pair of locking tabs 35 received in corresponding rear cutouts 142 of the first insulative housing 10. The locking tabs 35 can be further stamped to attach the inclined surfaces 143 for improving engaging force and achieving better fixation effect. As shown in FIG. 2, with the protrusions 122 received in the rectangular openings 331 and the locking tabs 35 received in the rear cutouts 142, the first metallic shell 30 can be restricted with respect to the first insulative housing 10 along the front and back direction, not only a front-to-back direction but also a back-to-front direction.

Figure 10:
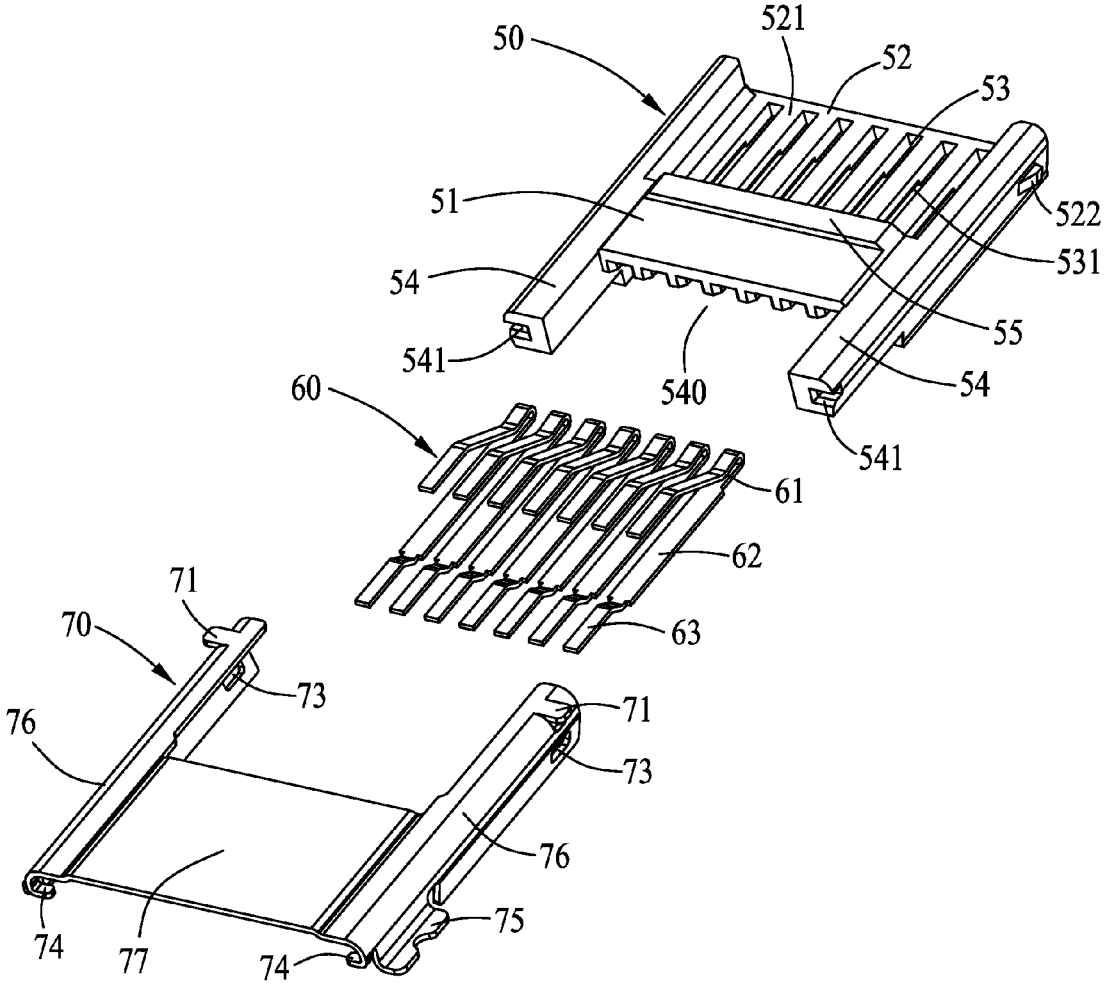
FIG. 10 is an exploded view of the plug connector as shown in FIG. 9.

Referring to FIGS. 9 and 10, the plug connector 200 includes a second insulative housing 50, a plurality of second contacts 60 retained in the second insulative housing 50 and a second metallic shell 70 fixed to the second insulative housing 50.

Figure 11:
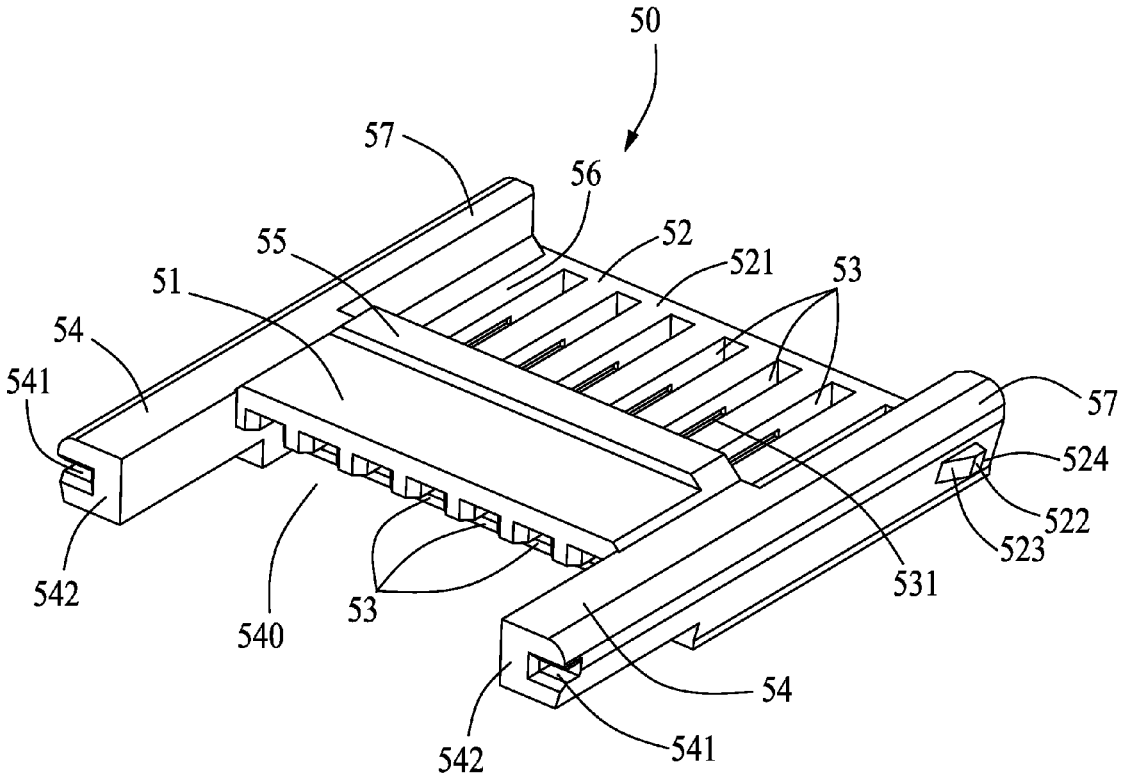
FIG. 11 is a perspective view of a second insulative housing of the plug connector as shown in FIG. 10.
Figure 12:
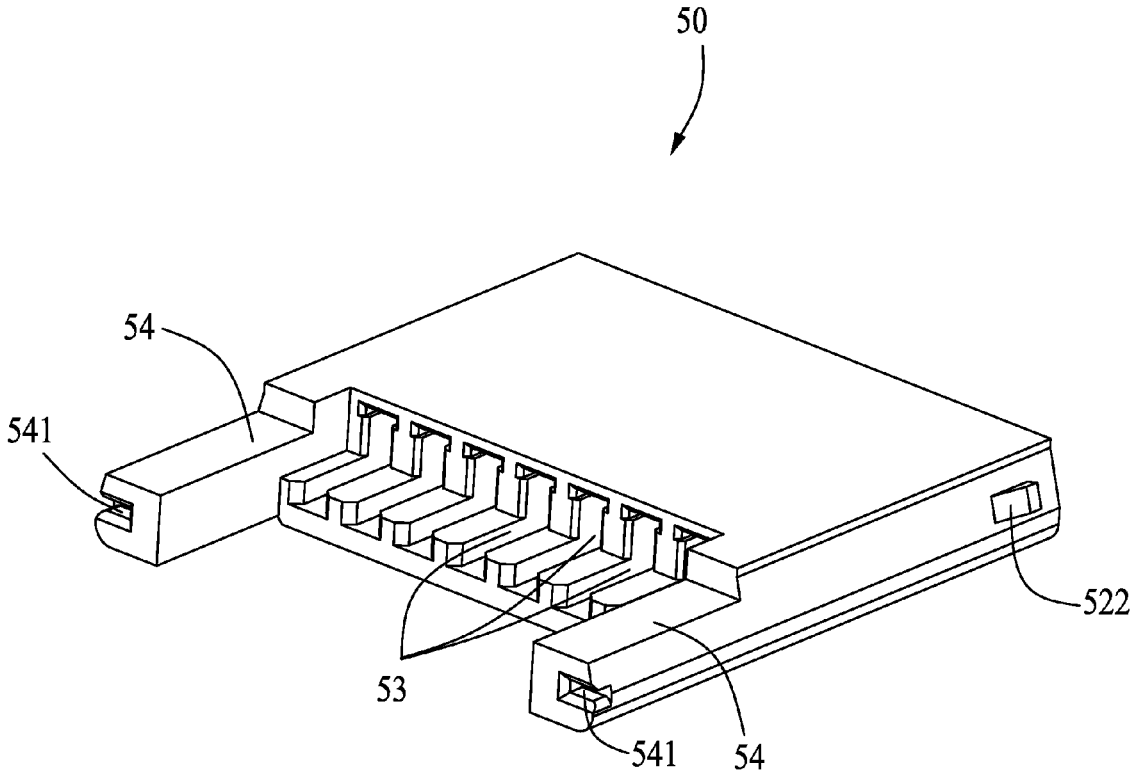
FIG. 12 is another perspective view of the second insulative housing while taken from a different aspect.

Referring to FIGS. 10 to 12, the second insulative housing 50 includes a second body 51, a cavity 56 for receiving the first tongue 12, a second tongue 52 exposed to the cavity 56, and a pair of extensions 54 extending from opposite sides of the second body 51. The second body 51 and the pair of extensions 54 jointly form a U-shaped second mounting space 540. The second body 51 includes a raised flange 55. The second tongue 52 extends horizontally from the second body 51 and defines a top mating surface 521 and a plurality of second passageways 53 extending through the top mating surface 521. Furthermore, the second passageways 53 extend through the second body 51 along the front and back direction for mounting the second contacts 60. Besides, the second tongue 52 defines a plurality of enlarged slots 531 each of which is located at the bottom of corresponding second passageway 53. The second insulative housing 50 includes a pair of side walls 57 with the cavity 56 formed therebetween. Each side wall 57 includes a protrusion 522 extending sidewardly therefrom. The protrusion 522 includes an inclined surface 523 and a locking surface 524. Each extension 54 includes a slit 541 extending through an end surface 542 thereof for fixing the second metallic shell 70 along a back-to-front direction.

Figure 13:
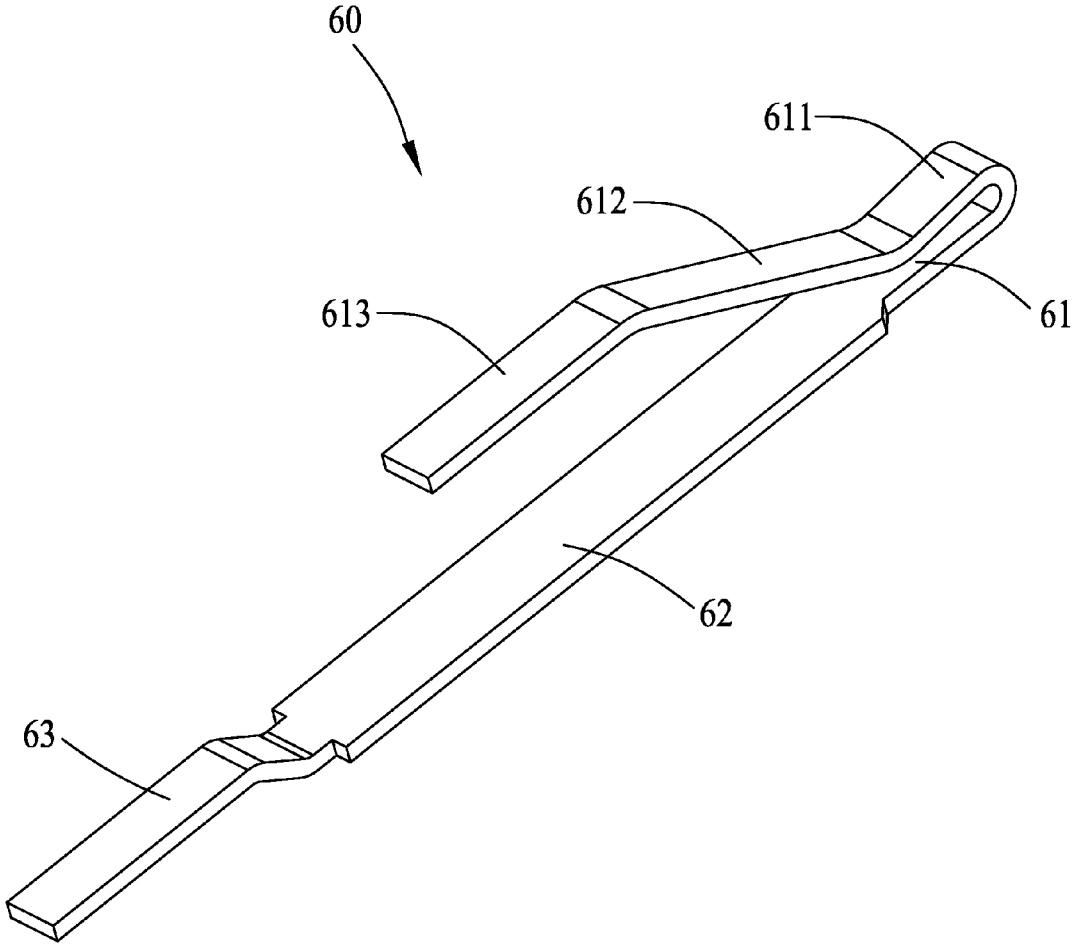
FIG. 13 is a perspective view of a second contact of the plug connector.

Referring to FIGS. 10 and 13, each second contact 60 includes a second retaining portion 62, a second soldering portion 63 extending backwardly from the second retaining portion 62 and a contacting arm 61 extending forwardly and upwardly from the second retaining portion 62. The contacting arm 61 includes a U-shaped portion 611, an inclined arm 612 extending backwardly and upwardly from a top end of the U-shaped portion 611, and a second contacting portion 613 extending backwardly and horizontally from the inclined arm 612. The second retaining portion 62 is wider than any other part of the second contact 60 and is fixed in corresponding enlarged slot 531 for fixation. The second soldering portion 63 extends into the second mounting space 540. The inclined arm 612 and the second contacting portion 613 are located above the second retaining portion 62 and extend beyond the top mating surface 521. The second contacting portion 613 is flat and elastic for engaging with the first contacting portion 21 for enlarging mating surface and improving mating stability therebetween.

Figure 14:
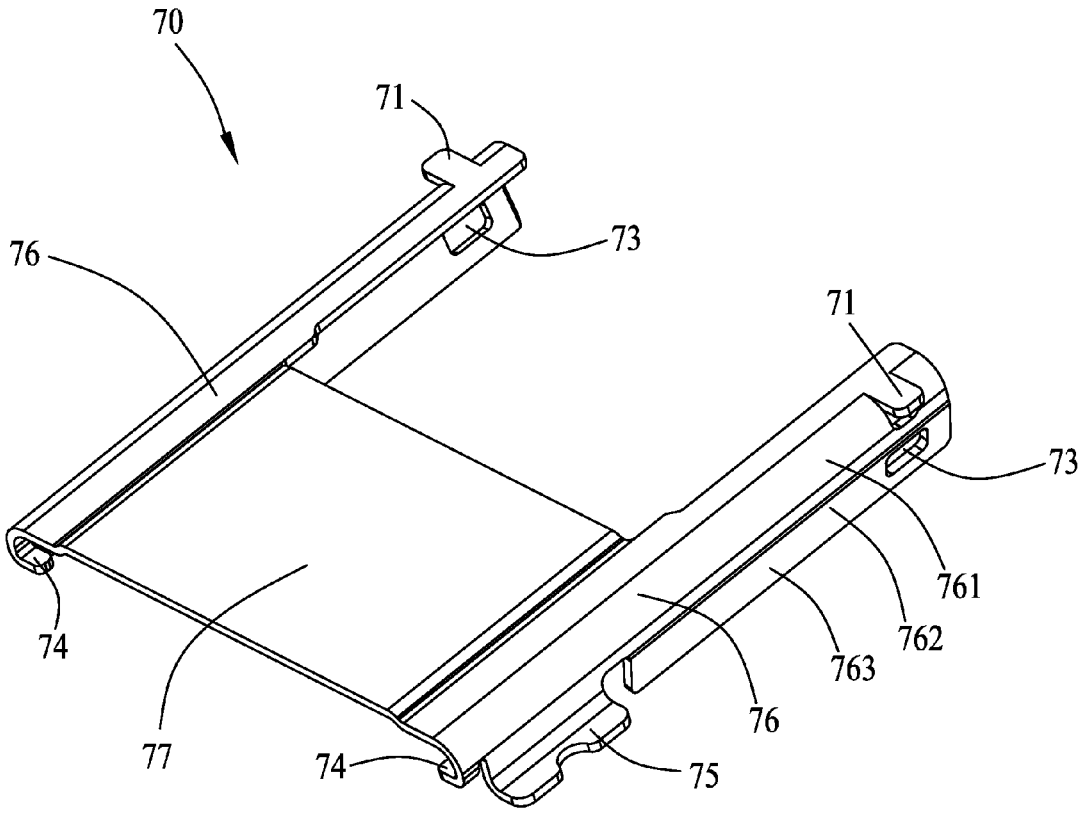
FIG. 14 is a perspective view of a second metallic shell of the plug connector as shown in FIG. 10.

Referring to FIGS. 10 and 14, the second metallic shell 70 includes a pair of side sections 76 and a top wall 77 bridging the side sections 76. The pair of side sections 76 are symmetrical with each other. Each side section 76 includes an upper wider section 761, a lower narrower section 762 and a recess 763 located under the upper wider section 761 and outwardly beside the lower narrower section 762. Besides, each side section 76 includes a flat horizontal wing 71 for being received in the positioning slots 36 of the first metallic shell 30, a slot 73 for receiving the protrusion 522, a positioning tab 74 inserted into the slit 541 along a back-to-front direction, and a second soldering pad 75 sidewardly extending beyond the side section 76 for being soldered to the circuit board 300.

In assembling, the first metallic shell 30 is assembled to the first insulative housing 10 along a vertical direction and the second metallic shell 70 is assembled to the second insulative housing 50 along a horizontal direction perpendicular to the vertical direction. Under the guidance of the inclined surfaces 523, the protrusions 522 of the second insulative housing 50 are easily received in the slots 73 of the second metallic shell 70. The locking surfaces 524 engage with the slots 73 for fixation. The raised flange 55 of the second insulative housing 50 restricts against the top wall 77 of the second metallic shell 70 for preventing over insertion.

The plug connector 200 is mateable with the receptacle connector 100 along the bottom-to-top direction for achieving stable mating effect therebetween. Accordingly, under such arrangement, the structures of the plug connector 200 and the receptacle connector 100 can be simplified. During such mating, the pair of side sections 76 of the plug connector 200 are guided by the lower arms 322 of the pair of cantilevered claws 32. The pair of cantilevered claws 32 are outwardly deformable under the drive of the upper wider sections 761. Once the locking protrusions 323 pass the upper wider sections 761, the pair of cantilevered claws 32 release their elasticity so as to make the locking protrusions 323 protrude into the recesses 763. The locking protrusions 323 are restricted by the upper wider sections 761 along the bottom-to-top direction. The pair of cantilevered claws 32 engage against the pair of side sections 76 so as to clamp the plug connector 200 in position. As a result, the plug connector 200 can be prevented from falling off from the receptacle connector 100 along the top-to-bottom direction. Meanwhile, the first tongue 12 is received in the cavity 56 of the second insulative housing 50. The first contacting portions 21 and the second contacting portions 613 engage with each other. The horizontal wings 71 of the second metallic shell 70 are received in the positioning slots 36 of the first metallic shell 30 along the bottom-to-top direction. Under this condition, even if a backward horizontal pulling force is applied to the plug connector 200, under the horizontal wings 71 resisting against the cantilevered claws 32, the plug connector 200 can be prevented from withdrawing from the receptacle connector 100 along the back-to-front direction.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector assembly comprising:

a receptacle connector comprising:

a first insulative housing provided with a first body and a first tongue extending horizontally from the first body, the first tongue defining a bottom mating surface;

a plurality of first contacts retained in the first insulative housing, each first contact comprising a first/rigid contacting portion exposed on the bottom mating surface; and a first metallic shell fixed to the first insulative housing and comprising a pair of cantilevered claws extending downwardly from opposite sides thereof, the pair of cantilevered claws being positioned at lateral sides of the first tongue; and a plug connector for mating with the receptacle connector, the plug connector comprising:

a second insulative housing comprising a second body and a second tongue extending horizontally from the second body, the second tongue defining a top mating surface; and a plurality of second contacts retained in the second insulative housing, each second contact comprising a second/elastic contacting portion extending upwardly beyond the top mating surface; wherein the plug connector is mated with the receptacle connector along a bottom-to-top direction with the first/rigid contacting portions engaging with the second/elastic contacting portions, the pair of cantilevered claws being deformable so as to clamp the plug connector in position and preventing the plug connector from falling off from the receptacle connector along a top-to-bottom direction.

2. The electrical connector assembly as claimed in claim 1, wherein a space is formed by the pair of cantilevered claws to receive the plug connector, each cantilevered claw comprising an upper arm extending obliquely and inwardly into the space and a lower arm extending outwardly with respect to the upper arm, the lower arms of the pair of cantilevered claws being of an evase configuration for guiding insertion of the plug connector into the space along the bottom-to-top direction.

3. The electrical connector assembly as claimed in claim 2, wherein the first metallic shell comprises a top wall covering the first body and the first tongue, the pair of cantilevered claws bent downwardly from opposite sides of the top wall.

4. The electrical connector assembly as claimed in claim 3, wherein the first metallic shell comprises a front portion bent downwardly from a front edge of the top wall, the front portion shielding a front surface of the first tongue, the first tongue comprising at least one protrusion extending forwardly beyond the front surface, a joint of the front portion and the top wall defining at least one opening to receive the at least one protrusion for fixation.

5. The electrical connector assembly as claimed in claim 3, wherein the first metallic shell comprises a pair of side portions bent downwardly from the opposite sides of the top wall, the side portions being located behind the cantilevered claws, each side portion comprising a retaining portion fixed in a slit of the first body.

6. The electrical connector assembly as claimed in claim 5, wherein the first body comprises a top restricting wall in communication with corresponding slit, the retaining portion comprising a slant tab extending along the bottom-to-top direction, the top restricting wall pressing against the slant tab along the bottom-to-top direction so as to prevent the retaining portion from escaping the slit.

7. The electrical connector assembly as claimed in claim 1, wherein the insulative housing comprises a pair of rear portions extending backwardly from the first body, the pair of rear portions jointly with the first body forming a U-shaped first mounting space, each first contact comprising a first soldering portion extending into the first mounting space, each rear portion defining a rear cutout and the first metallic shell comprising a pair of locking tabs received in the rear cutouts.

8. The electrical connector assembly as claimed in claim 1, wherein the pair of cantilevered claws are integral with the first metallic shell.

9. The electrical connector assembly as claimed in claim 2, wherein the plug connector comprises a second metallic shell fixed to the second insulative housing, the second metallic shell comprising a pair of side sections against which the pair of cantilevered claws engage.

10. The electrical connector assembly as claimed in claim 9, wherein each side section of the second metallic shell comprises an upper wider section, a lower narrower section and a recess located under the upper wider section and beside the lower narrower section, each cantilevered claw comprising an inward locking protrusion at a peak of the upper arm and the lower arm, the locking protrusion extending into the recess so as to be restricted by the upper wider section along the bottom-to-top direction.

11. The electrical connector assembly as claimed in claim 9, wherein the first metallic shell defines a pair of positioning slots behind the cantilevered claws and each side section of the second metallic shell comprises a horizontal wing received in corresponding positioning slot along the bottom-to-top direction, the horizontal wings resisting against the cantilevered claws so as to prevent the plug connector from withdrawing from the receptacle connector along a rear-to-front direction.

12. The electrical connector assembly as claimed in claim 9, wherein the second tongue defines a plurality of passageways extending through the top mating surface to receive the second contacts, the second insulative housing comprising a pair of extensions extending from the second body opposite to the second tongue, the pair of extensions jointly with the second body forming a U-shaped second mounting space, each second contact comprising a second soldering portion extending into the second mounting space.

13. The electrical connector assembly as claimed in claim 12, wherein each extension defines a slit extending through an end surface thereof, the second metallic shell comprises a pair of positioning tabs inserted in the slits along a horizontal direction.

14. The electrical connector assembly as claimed in claim 13, wherein the second metallic shell comprises a top wall bridging the pair of side sections, the second body comprising a raised flange for restricting against the top wall when the second metallic shell is assembled to the second insulative housing along the horizontal direction.

15. An electrical connector assembly comprising:

a receptacle connector comprising:

a first insulative housing comprising a first tongue which defines a bottom mating surface;

a plurality of first contacts retained in the first insulative housing, each first contact comprising a first contacting portion exposed on the bottom mating surface; and a first metallic shell fixed to the first insulative housing and comprising a pair of cantilevered claws extending downwardly from opposite sides thereof and a pair of positioning slots located behind corresponding cantilevered claws, the pair of cantilevered claws being positioned at lateral sides of the first tongue; and a plug connector for mating with the receptacle connector, the plug connector comprising:

a second insulative housing defining a cavity to receive the first tongue and a top mating surface exposed to the cavity;

a plurality of second contacts retained in the second insulative housing, each second contact comprising a second contacting portion extending upwardly beyond the top mating surface and into the cavity; and a second metallic shell fixed to the second insulative housing and comprising a pair of side sections, each side section comprising a pair of horizontal wings received in the positioning slots; wherein the plug connector is mated with the receptacle connector along a bottom-to-top direction with the first contacting portions engaging with the second contacting portions, the pair of cantilevered claws clamping the side sections of the plug connector in position and preventing the plug connector from falling off from the receptacle connector along a top-to-bottom direction, the pair of horizontal wings received in the positioning slots and resisting against the cantilevered claws so as to prevent the plug connector from withdrawing from the receptacle connector along a rear-to-front direction.

16. The electrical connector assembly as claimed in claim 15, wherein a space is formed by the pair of cantilevered claws to receive the plug connector, each cantilevered claw comprising an upper arm extending obliquely and inwardly into the space and a lower arm extending outwardly with respect to the upper arm, the lower arms of the pair of cantilevered claws being of an evase configuration for guiding insertion of the plug connector into the space along the bottom-to-top direction.

17. The electrical connector assembly as claimed in claim 15, wherein each side section of the second metallic shell comprises an upper wider section, a lower narrower section and a recess located under the upper wider section and beside the lower narrower section, each cantilevered claw comprising an inward locking protrusion at a peak of the upper arm and the lower arm, the locking protrusion extending into the recess so as to be restricted by the upper wider section along the bottom-to-top direction.

18. The electrical connector assembly as claimed in claim 15, wherein the first metallic shell is assembled to the first insulative housing along a vertical direction, and the second metallic shell is assembled to the second insulative housing along a horizontal direction perpendicular to the vertical direction.

19. The electrical connector assembly as claimed in claim 15, wherein the pair of cantilevered claws are integral with the first metallic shell.

20. The electrical connector assembly as claimed in claim 15, wherein the first contacting portions and the second contacting portions are flat, the first contacting portions are rigid while the second contacting portions are elastic.

* * * * *